US007810660B1

(12) United States Patent
Dunham

(10) Patent No.: US 7,810,660 B1
(45) Date of Patent: Oct. 12, 2010

(54) MODEL RAILROAD COUPLER

(75) Inventor: Michael Nathan Dunham, Central Point, OR (US)

(73) Assignee: Kadee Quality Products Co., White City, OR (US)

( * ) Notice: Subject to any disclaimer, the term of this patent is extended or adjusted under 35 U.S.C. 154(b) by 0 days.

(21) Appl. No.: 12/459,354

(22) Filed: Jun. 29, 2009

(51) Int. Cl.
*B61G 7/04* (2006.01)

(52) U.S. Cl. ..... 213/75 TC; 213/75 A

(58) Field of Classification Search ..... 213/75 TC
See application file for complete search history.

(56) References Cited

U.S. PATENT DOCUMENTS

| | | | | | |
|---|---|---|---|---|---|
| 3,111,229 | A | * | 11/1963 | Edwards et al. | 213/212 |
| 3,115,255 | A | | 12/1963 | Edwards et al. | |
| 3,117,676 | A | * | 1/1964 | Edwards et al. | 213/211 |
| 3,469,713 | A | * | 9/1969 | Edwards et al. | 213/75 TC |
| 3,564,766 | A | | 2/1971 | Edwards et al. | |
| 3,605,332 | A | * | 9/1971 | Stepek | 213/75 TC |
| 3,942,648 | A | | 3/1976 | Edwards et al. | |
| 4,335,820 | A | | 6/1982 | Gramera | |
| D326,693 | S | | 6/1992 | Gramera | |
| 5,316,158 | A | * | 5/1994 | Dunham et al. | 213/75 TC |
| 5,509,546 | A | * | 4/1996 | Staat | 213/75 TC |
| 5,662,229 | A | * | 9/1997 | Edwards | 213/75 TC |
| 5,775,524 | A | * | 7/1998 | Dunham | 213/75 TC |
| 5,785,192 | A | * | 7/1998 | Dunham et al. | 213/75 TC |
| 5,823,371 | A | * | 10/1998 | Riley et al. | 213/75 TC |
| 5,931,322 | A | * | 8/1999 | Storzek | 213/75 TC |
| 6,189,713 | B1 | * | 2/2001 | Oh | 213/75 TC |
| 6,308,845 | B1 | * | 10/2001 | Sergent, IV | 213/75 TC |
| 2005/0167386 | A1 | * | 8/2005 | Barger et al. | 213/75 TC |
| 2009/0014402 | A1 | * | 1/2009 | Wolf et al. | 213/75 TC |
| 2009/0114614 | A1 | * | 5/2009 | Dudley | 213/75 TC |

* cited by examiner

*Primary Examiner*—S. Joseph Morano
*Assistant Examiner*—Jason C Smith
(74) *Attorney, Agent, or Firm*—Robert D. Varitz, PC

(57) ABSTRACT

A model railroad coupler for use with model railroad rolling stock includes a coupler head and a coupler knuckle carried pivotally on the coupler head; an elongate coupler shank having one end thereof fixed to the coupler head; a coupler mounting structure carried at the other end of the coupler shank, the shank having a shank longitudinal axis; wherein the coupler head includes a coupler head side flange thereon for preventing over rotation of the coupler knuckle, the coupler head side flange having a flat, inner-facing surface which is parallel to the shank axis; and wherein the coupler mounting structure includes a coupler centering surface adjacent an end thereof, wherein the coupler centering surface has a first, co-linear portion and a second, angled portion wherein a first fulcrum point is located between the first, co-linear portion and the second, angled portion and a second fulcrum point located at an outer margin of the coupler centering surface.

8 Claims, 4 Drawing Sheets

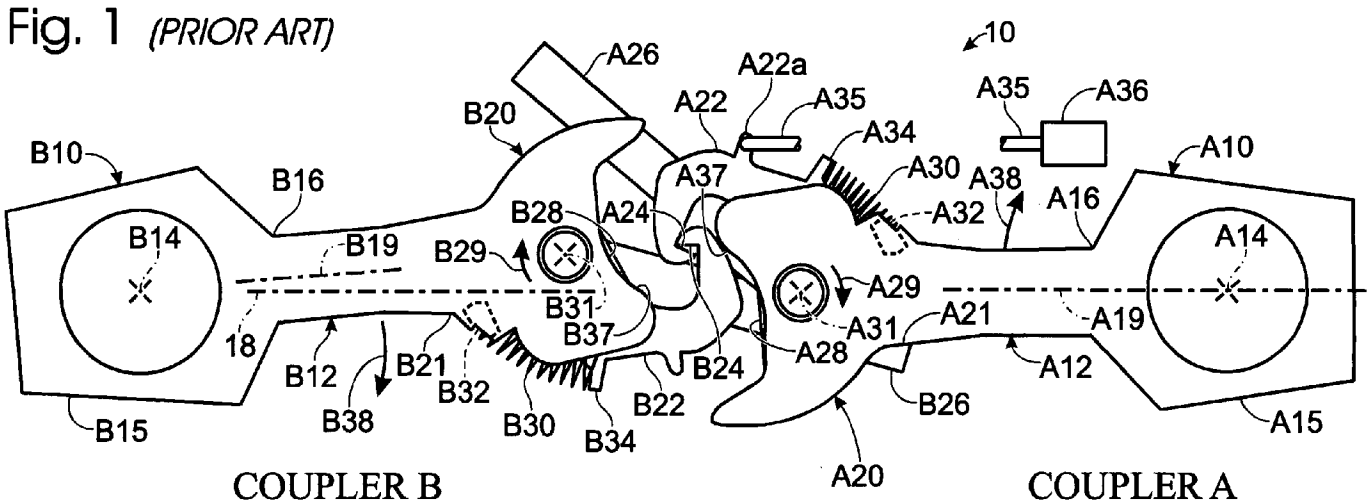
Fig. 1 *(PRIOR ART)*
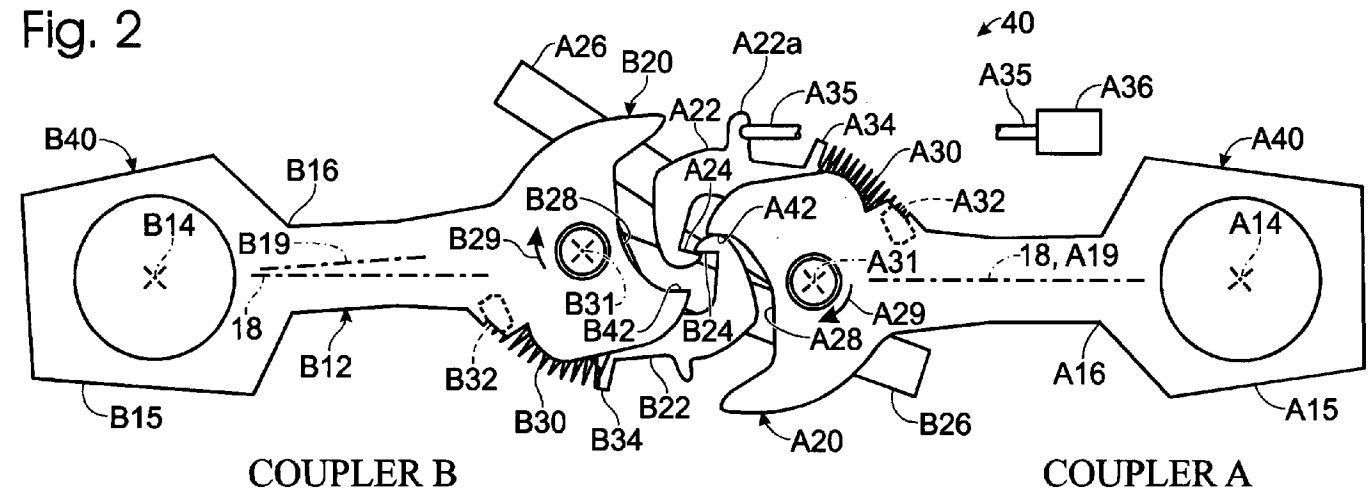
Fig. 2

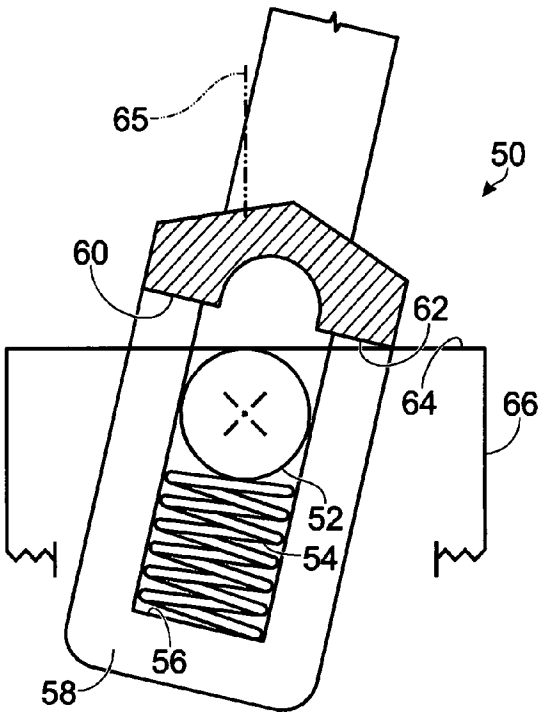
Fig. 6 *(PRIOR ART)*
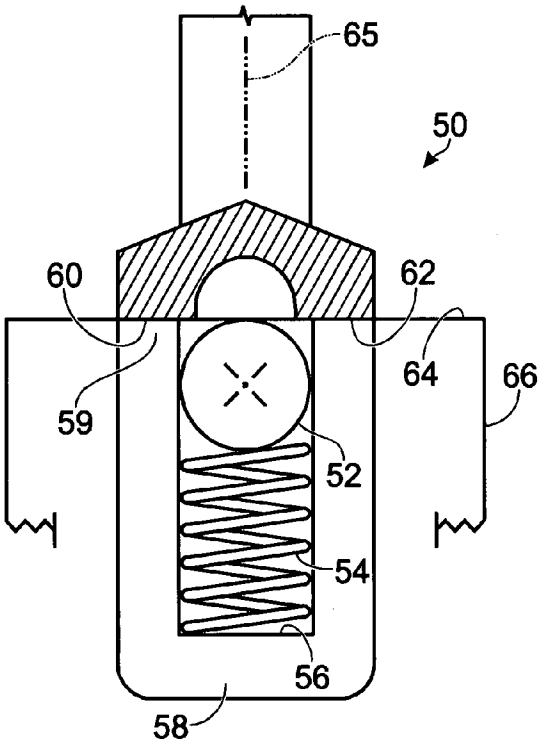
Fig. 5 *(PRIOR ART)*

MODEL RAILROAD COUPLER

FIELD OF THE INVENTION

This invention relates to couplers for model railroads, and specifically to an improved magnetically-actuated/remotely mechanically actuated coupler which is operable when the coupler is placed under lateral stresses.

BACKGROUND OF THE INVENTION

It is a goal of model railroaders to build and run model railroad rolling stock which is as close to that used in prototype railway rolling stock as is possible. To this end, a great deal of effort is expended in order to duplicate, in scale, all of the features of prototypical rolling stock. In the case of couplers for prototypical rolling stock, as are used in the western hemisphere, couplers are made with a coupler head, attached to a shank, which is in turn connected to the rolling stock by means of a draft box. Attached to the coupler head is a knuckle which engages a like knuckle on another unit of rolling stock. Such structures are present on both prototypical railway and some model railroad couplers, however, the couplers that have been in use on model railroads deviate to a greater or lesser degree, depending on manufacturer, from the prototypical in order to accommodate the much smaller scale of the coupler components.

Another desirable feature of a model railroad coupler is the ability to remotely uncouple units of rolling stock from one another without physically handling the units of rolling stock. One form of remote uncoupling involves the use of a coupler, which is made of a non-magnetic material, with a simulated air hose, which is made from a magnetically-active metal, and which, when subjected to a magnetic field, may be caused to swing, shifting the coupler knuckle into an open position, when the simulated air hose is positioned over a magnetic ramp, whether such ramp be a permanent magnet or an electromagnet. A number of such magnetically actuated model railroad uncouplers are disclosed in patents to Edwards et al., such as U.S. Pat. Nos. 3,111,229, 3,115,255, 3,117,676, 3,469,713, 3,564,766, and 3,942,648. Variations on the magnetic couplers of Edwards et al. are depicted in U.S. Pat. No. 5,785,192 to Dunham et al., the full disclosure of which is incorporated herein by reference, U.S. Pat. No. 4,335,820 to Gramera, U.S. Pat. No. D326,693, also to Gramera, and U.S. Pat. No. 5,509,546 to Staat. Another for of remote uncoupling involves linking a coupler to a remote uncoupling actuator, which is an electromechanical device, which is remotely triggered, e.g., by DCC. Although some units of model railroad rolling stock may be equipped with a remote uncoupler actuator, it is desirable to have all couplers capable of magnetically actuated uncoupling.

The forgoing references are all magnetically actuated, however, problems arise when (1) only one coupler is mechanically (vice mechanically) actuated, as by a remote uncoupling operation, wherein only one coupler knuckle may open, resulting in "jamming," or locking of the two couplers together, prevent uncoupling; and (2) in the case of travel over a magnetic uncoupling ramp, a well known device to those of ordinary skill in the art, prior to "delayed uncoupling", i.e., positioning the coupler knuckles in an uncoupled position and then backing the train to the location where the train is to be split, travel over an uncoupling ramp may result in the lead coupler pulling the trailing coupler off center, which may prevent the coupler knuckle on the trailing coupler from uncoupling and preventing the necessary relative swinging of the couplers for delayed uncoupling.

SUMMARY OF THE INVENTION

A model railroad coupler for use with model railroad rolling stock having a rolling stock longitudinal axis, and a coupler box for receiving the coupler therein, the coupler box located about the rolling stock longitudinal axis and further having a coupler pivot pin therein, comprising: (1) a coupler head and a coupler knuckle carried pivotally on the coupler head; (2) an elongate coupler shank having one end thereof fixed to the coupler head; (3) a coupler mounting structure carried at the other end of the coupler shank, the shank having a shank longitudinal axis; wherein the coupler head includes a coupler head side flange thereon for preventing over rotation of the coupler knuckle, the coupler head side flange having a flat, inner-facing surface which is parallel to the shank axis. A variant of the invention includes a coupler mounting structure having an elongate slot therein, a coupler centering spring seat at one end thereof and a spring interposed the coupler centering spring seat and a pivot pin for maintaining the coupler in a centered position when the shank longitudinal axis and the rolling stock longitudinal axis are substantially parallel, the coupler mounting structure having a coupler centering surface adjacent another end thereof for providing at least a two position swinging of the coupler during an uncoupling operation, wherein the coupler centering surface has a first, co-linear portion and a second, angled portion, wherein a first fulcrum point is located between the first, co-linear portion and the second, angled portion and a second fulcrum point located at an outer margin of the coupler centering surface.

It is an object of the invention to provide reliable remote uncoupling of model railroad rolling stock.

Another object of the invention is to provide a modified coupler head structure which will reliable disengage a like coupler head structure when only one coupler is activated.

A further object of the invention is to provide a multi-position centering mechanism to facilitate uncoupling.

This summary and objectives of the invention are provided to enable quick comprehension of the nature of the invention. A more thorough understanding of the invention may be obtained by reference to the following detailed description of the preferred embodiment of the invention in connection with the drawings.

BRIEF DESCRIPTION OF THE DRAWINGS

FIG. 1 depicts prior art construction of one form of the coupler head of magnetically actuated model railroad couplers.

FIG. 2 depicts construction of model railroad coupler heads according to the present invention, in a coupled condition.

FIGS. 5 and 6 depict a prior art coupler centering mechanism, with FIG. 5 depicting the mechanism in a non-deflected position and FIG. 6 depicting the mechanism in a deflected position.

DETAILED DESCRIPTION OF THE PREFERRED EMBODIMENT

Figure 3:
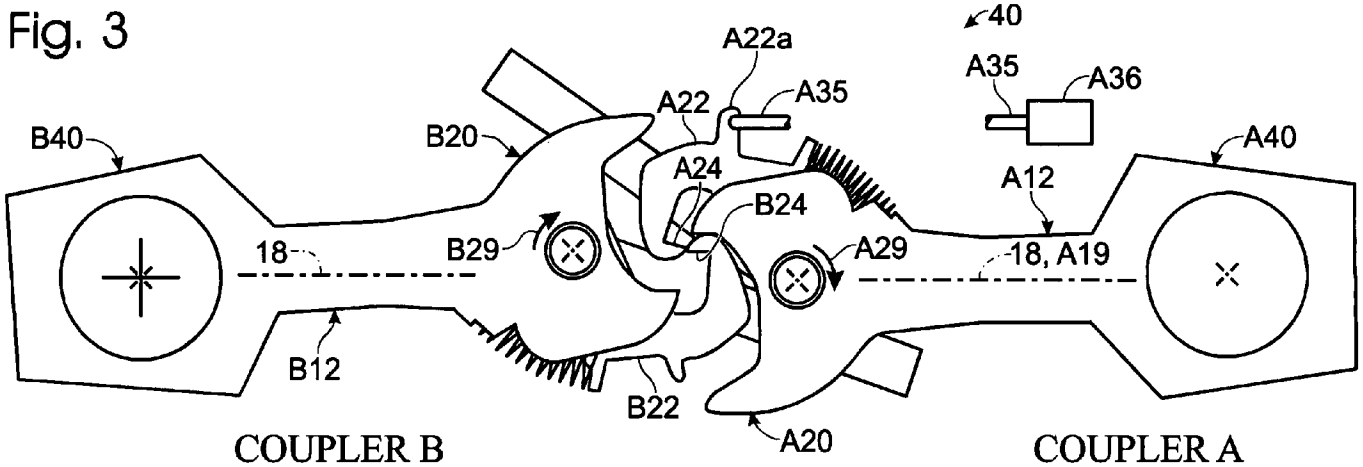
FIG. 3 depicts the coupler of FIG. 2 in an intermediate condition in anticipation of uncoupling.

Referring to the drawing figures, it will be appreciated that the new coupler head and centering mechanism may be used in the same coupler, however, for purposes of clarity, they are not shown in a single drawing figure.

Referring now to FIG. 1, prior art couplers are depicted generally at 10. Two couplers, coupler A and coupler B are depicted, each having essentially the same elements and like reference numbers. The notation A, i.e., A10 refers to coupler A and B10** refers to coupler B, is used herein. If an "A" or "B" is not indicated, the reference character refers to both couplers. Coupler A, as described herein, is the "lead" coupler, i.e., attached to a piece of rolling stock which is exerting a pulling force on the "trailing" coupler, i.e., coupler B. In the first portion of this description, the lead coupler is mechanically actuated remotely, e.g., by an actuator carried in the rolling stock to which coupler A is fixed, and which may respond to a remote signal, such as provided by the DCC protocol.

The couplers include a shank 12 which is attached to a piece of model railroad rolling stock, such as a car or locomotive (not shown), and is free to pivot about an attachment point 14, located at one end 16 of shank 12, which attachment point is centered in a coupler mounting structure 15. The coupler incorporates some form of centering mechanism to hold the coupler in alignment with the central longitudinal axis of the rolling stock, shown as a dash-dot line 18. One forth of centering mechanism is taught in U.S. Pat. No. 5,662,229, to Edwards, the full disclosure of which is incorporated herein by reference. This form of centering mechanism is used when the coupler is mounted immediately adjacent and end of the rolling stock. Another form of centering mechanism will be described later herein.

A shank longitudinal axis 19 extends along shank 12. Couplers 10 also include a coupler head 20, located at the other end 21 of shank 12, and a coupler knuckle 22, having a knuckle finger 24 thereon. Fingers 24 prevent unintentional disengagement of the couplers, but must clear one another in order for the couplers to disengage and complete an uncoupling operation. A simulated air hose, made of a magnetically responsive material, is depicted at 26, and serves to rotatably fix knuckle 22 within a knuckle receiver 28, located in coupler head 20, to allow pivotal motion of knuckle 22 relative to coupler head 20, in the direction of arrow 29 about a rotation point 31 for an uncoupling operation, and also to serve as an actuator under the influence of a magnetic field. Coupler shank 12, head 20 and knuckle 22 are fabricated of a non-magnetic material, e.g., a non-ferrous metal or a polymer. Shank longitudinal axis 19 extends through attachment point 14 and rotation point 31. A knuckle spring 30 extends between a shank boss 32, located on shank 12 and a knuckle boss 34, located on knuckle 22. Spring boss 32 and knuckle boss 34 provide knuckle stops which absolutely prevent further rotation of the associated knuckles, as described in U.S. Pat. No. 5,785,192, cited above. Knuckle stops may also be integrally formed structures located on that portion of a knuckle which is enclosed in the coupler head, which formed structures cooperate with compatible structures in the coupler head to limit knuckle rotation.

In the case of coupler A, a knuckle link A22*a* is provided and has a connecting rod A35 attached thereto. The free end of rod A35 is connected to a remote uncoupling actuator A36, mounted in the rolling stock body and depicted somewhat schematically in the drawings. Upon activation of actuator A36, rod A35 both opens knuckle A22 and shifts coupler A in the direction of arrow A38.

As illustrated in FIG. 1, when couplers A and B are moved to an imminent uncoupling position, as shown, upon activation of remote uncoupling actuator A36, knuckle B22 may become trapped against a portion of coupler head A20, which is designated A37, and referred to herein as a coupler head side flange. Under normal circumstances, when the train is backed or stopped quickly over an uncoupling ramp, the knuckles of coupler A and coupler B will disengage, allowing the couplers to swing to opposite sides, in the direction of arrows A38 and B38, under the influence of the uncoupling ramp, thereby uncoupling the rolling stock to which the couplers are attached.

However, when a mechanically remote uncoupling operation is initiated, not over an uncoupling ramp, knuckle B22 is not shifted to an open position, as it would be under the influence of the magnetic field of an uncoupling ramp. Knuckle A22, on the other hand, under the influence of actuator A36 and rod A35, tries to shift to its fully open position, as limited by the associated knuckle stops, a movement of about 20° from its centered, closed position, in the direction of arrow A29, resulting however, in entrapment of knuckle B22, which will not allow knuckle A22 fully to open and also prohibits coupler A fully to swing in the direction of arrow A38, and uncouple, as knuckle fingers A24 and B24 are not able to disengage. When the remote uncoupling actuator is deactivated, the couplers will return to their centered positions, and the rolling stock will remain coupled.

Turning now to FIG. 2, couplers 40 constructed according to the invention incorporate a modified form of a coupler head side flange, or side flange, which are depicted at A42, B42, which include a relatively flat inner-facing surface, e.g., facing towards shank longitudinal axis 19, which prevents over-rotation of the mechanically actuated opposing knuckle, which, in the preferred embodiment, limits rotation of knuckle A22 to a rotation of about 13° in the direction of arrow A29 with the coupler heads aligned as depicted. Side flanges 42 are substantially parallel to shank axis 19, whereas the prior side flanges (A37, B37 in FIG. 1) have a rounded surface.

Figure 4:
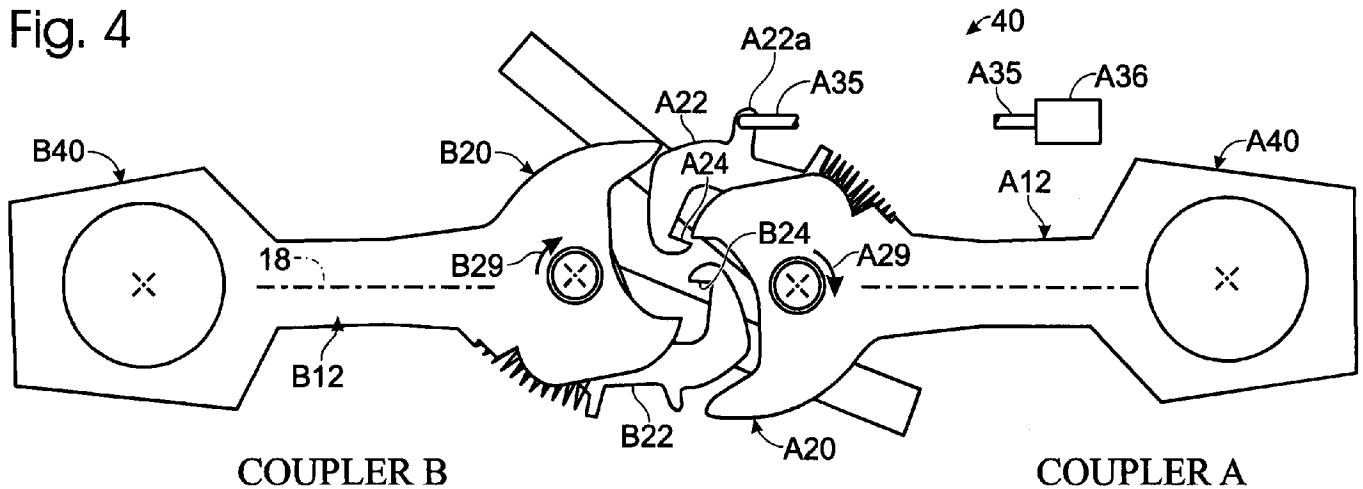
FIG. 4 depicts the coupler of FIG. 2 immediately prior to uncoupling.

Referring to FIG. 3, with knuckle B22 trapped against side flange A42, fingers A24, B24 will disengage and knuckle A22 may continue to open, which will cause the couplers to disengage and allows coupler A40 to swing to its fully open position. In FIG. 4, knuckle A22 has fully rotated to about 20° in the direction of arrow A29, and couplers A and B fully are disengaged. The provision of side flanges A42 and B42 prevent locking of fingers A24 and B24, thus facilitating uncoupling.

Referring now to FIGS. 5 and 6, a prior art centering mechanism is depicted. The centering mechanism, depicted generally at 50 is intended for use on rolling stock wherein the coupler mount is located inboard of the end of the rolling stock, requiring a long shank, which must move longitudinally relative to the rolling stock. Centering mechanism 50 is mounted on a coupler pivot pin 52, and maintained in a non-deflected position by a centering spring 54 which acts on coupler pivot pin 52 and on a coupler centering spring seat 56 at one end 58 of the coupler centering mechanism. Coupler centering surfaces 60, 62, located adjacent another end 59 of the coupler centering mechanism, rest on a stationary centering surface 64, which is part of a draft box, also referred to herein as a coupler box, shown in fragment at 66, which mounts the coupler to a piece of rolling stock, not shown.

Surfaces 60, 62 and 64 are co-linear in the prior art centering mechanism when the coupler is centered on a longitudinal axis 65 of the rolling stock. Surfaces 60, 62 and 64 are normal to longitudinal axis 65 when the coupler is centered, which is accomplished by the action of centering spring 54 on pivot pin 52 and coupler centering spring seat 56.

As the coupler is moved off center, a single fulcrum point 68 is established between one side of the coupler centering surface and a point on the stationary centering surface, which provides a single articulation between the coupler and the draft box, i.e., between the coupler centering surface and the stationary centering surface. This may, in some instances, generate a force on the coupler head, as a result of compression of spring 54, which inhibits full opening of the coupler knuckle, and results in an unsuccessful uncoupling operation. Thus, when two coupled couplers travel over a magnetic uncoupling ramp, the lead coupler may pull the trailing coupler off-center, or, when a single coupler is activated, as by a mechanical remote uncoupling actuator, as previously described herein. This may create a problem when the rolling stock is stopped over an uncoupling ramp and the train is backed to perform an uncoupling operation, or when only a single coupler is activated.

Figure 7:
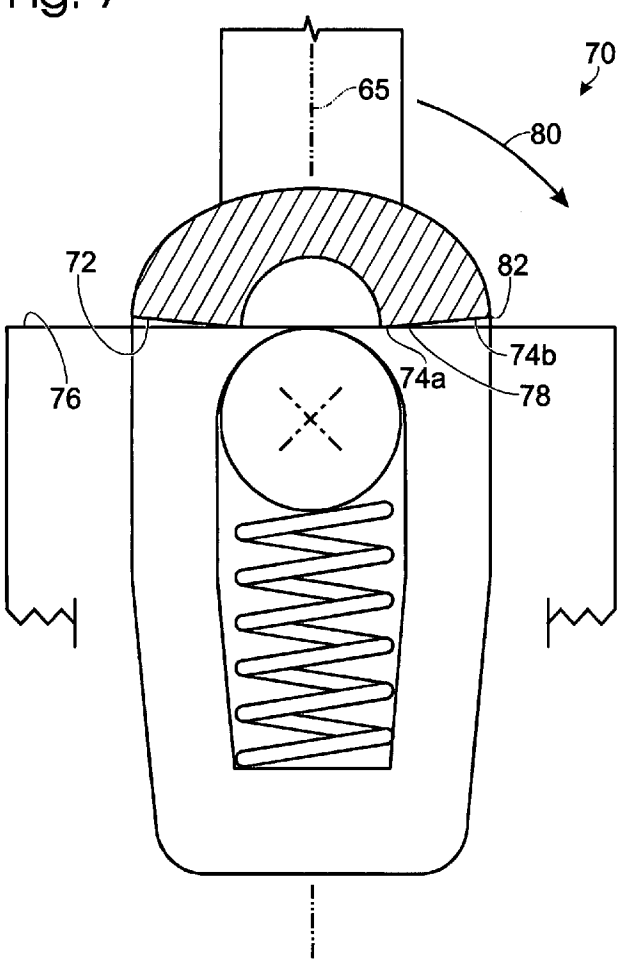
FIG. 7 depicts a coupler centering mechanism according to the present invention.

Referring now to FIG. 7, a centering mechanism 70 of the invention is depicted. When like elements of the prior art centering mechanism and the centering mechanism of the invention are present, like reference numbers are used. Centering mechanism 70 includes coupler centering surfaces 72, 74, also referred to herein as delayed toggle stop surfaces, which act on a stationary centering surface 76, which stationary centering surface is still normal to rolling stock longitudinal axis 65. In the preferred embodiment, coupler centering surface 74 has a first, co-linear portion, 74*a*, and a second, angled portion, 74*b*, which are angled by an amount of between about 2° to 5° from co-linear, which angled portion begins at a first fulcrum point 78. First co-linear portion 74*a* and second angled portion 74*b*, in the preferred embodiment, are located on what is referred to herein as a knuckle side, e.g., that side of the coupler to which the knuckle rotates during uncoupling. As a train moves over straight track, coupler centering surface 72 impinges on stationary centering surface 76, as does first co-linear portion 74*a*.

Figure 8:
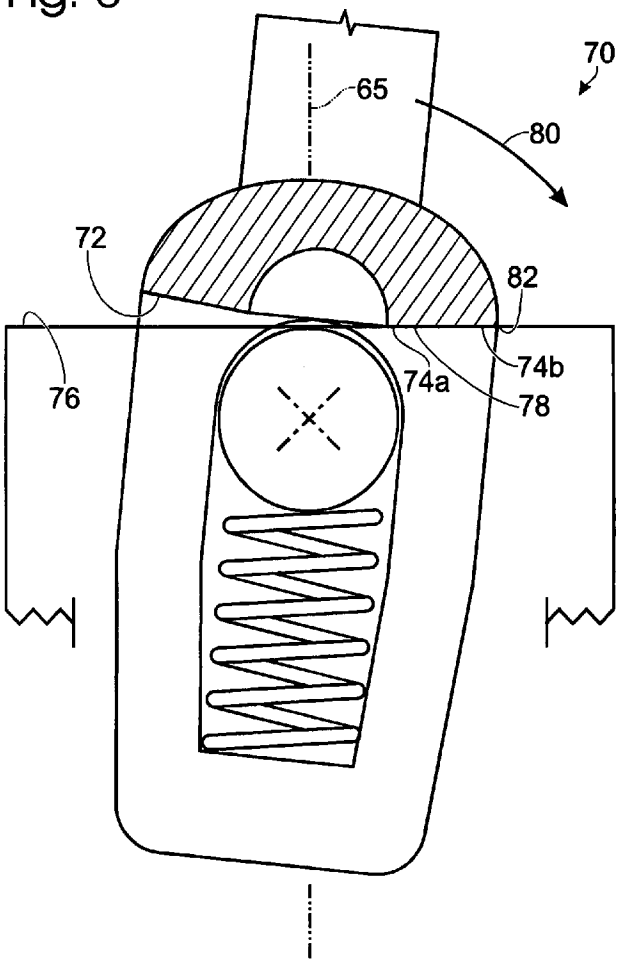
FIG. 8 depicts the coupler centering mechanism of FIG. 7 in a partially deflected position.

When a coupler is actuated, through the use of a force applied to the knuckle, either by a magnetic ramp or a remote uncoupling actuator, the coupler will rotate clockwise, in a delayed direction, arrow 80, a few degrees, e.g., about 2° to 5°, about a first fulcrum 78, allowing angled portion 74*b* of the centering surface of the coupler completely to impinge on stationary centering surface 76, as shown in FIG. 8, in which the angle of fulcrum 78 is exaggerated for drawing clarity. In this position, the knuckle is able to open. In the case of mechanical remote uncoupling, only the remotely activated coupler swings, which facilitates the disengagement of the knuckle and knuckle fingers, holding the shank in its now deflected position, and allowing the knuckle to rotate sufficiently to an uncoupling position.

Although the structure of the newly described centering mechanism is intended primarily to facilitate magnetic uncoupling over a magnetic ramp, the structure also facilitates remote uncoupling, wherein the mechanical actuation of a single coupler, because as the remotely actuated knuckle, knuckle A22 previously described herein, is pulled open mechanically, shank A12 will easily swing through the first 2° to 5° and stop against angled portion 74*b*. At this point, the continuation of actuation will open knuckle A22 far enough to "strip" knuckle finger B24 from knuckle finger A24 because knuckle B22 fully is impinged on side flange A42. Further movement of the shank in the direction of arrow 80 results in movement of coupler centering surface 74*b* on stationary centering surface 76 about second fulcrum 82, which requires more force that does rotation about fulcrum 78. Thus, the centering mechanism may be thought of as a multi-position, multi-force centering system.

The provision of the delayed toggle stop surface also facilitates movement in the delayed direction while limiting movement in the non-delayed (counter clockwise) direction as two couplers move over an uncoupling ramp. Thus far described, the structure of the centering mechanism includes two fulcrum and provides a two-stage rotation process about the two fulcrums. A cam mechanism may be provided which will provide somewhat of an infinitely variable rotation process. What is described is a process whereby an initial small movement of a coupler is followed by a more pronounced, larger deflecting movement of the coupler and the coupler(s) move to their uncoupling positions.

Thus, a coupler for model railroad rolling stock has been disclosed. It will be appreciated that further variations and modifications thereof may be made within the scope of the invention as defined in the appended claims.

I claim:

1. A model railroad coupler for use between two units of model railroad rolling stock, each unit of rolling stock having a rolling stock longitudinal axis, and a coupler box for receiving a coupler therein, the coupler box being located about the rolling stock longitudinal axis and further having a coupler pivot pin therein, each coupler comprising:

(1) a coupler head and a coupler knuckle carried pivotally on said coupler head;

(2) an elongate coupler shank having one end thereof fixed to said coupler head;

(3) a coupler mounting structure carried at the other end of said coupler shank, said shank having a shank longitudinal axis;

wherein said coupler head includes a coupler head side flange, having a flat, inner-facing surface which is parallel to said shank axis, thereon for preventing over rotation of said coupler knuckle and resultant entrapment of a knuckle on a connected unit of rolling stock.

2. The coupler of claim 1 wherein said coupler mounting structure includes an elongate slot therein having a coupler centering spring seat at one end thereof and a spring interposed said coupler centering spring seat and the pivot pin for maintaining the coupler in a centered position when said shank longitudinal axis and said rolling stock longitudinal axis are substantially parallel, said coupler mounting structure having a coupler centering surface adjacent another end thereof for providing at least a two position swinging of the coupler during an uncoupling operation, wherein said coupler centering surface has a first, co-linear portion and a second, angled portion, wherein a first fulcrum point is located between said first, co-linear portion and said second, angled portion and a second fulcrum point located at an outer margin of said coupler centering surface.

3. The coupler of claim 2 wherein said co-linear portion is parallel to said stationary centering surface and said angled portion is angled at between about 2° to 5° away from said co-linear portion.

4. A model railroad coupler for use between two units of model railroad rolling stock, each unit of rolling stock having a rolling stock longitudinal axis, and a coupler box for receiving a coupler therein, the coupler box being located about the rolling stock longitudinal axis and further having a coupler pivot pin therein, each coupler comprising:

(1) a coupler head and a coupler knuckle carried pivotally on said coupler head;

(2) an elongate coupler shank having one end thereof fixed to said coupler head;

(3) a coupler mounting structure carried at the other end of said coupler shank, said shank having a shank longitudinal axis;

wherein said coupler mounting structure includes an elongate slot therein having a coupler centering spring seat at one end thereof and a spring interposed said coupler centering spring seat and the pivot pin for maintaining the coupler in a centered position when said shank longitudinal axis and said rolling stock longitudinal axis are substantially parallel, said coupler mounting structure having a coupler centering surface adjacent another end thereof for providing at least a two position swinging of the coupler during an uncoupling operation, wherein said coupler centering surface has, on a knuckle side only thereof, a first, co-linear portion and a second, angled portion, wherein a first fulcrum point is located between said first, co-linear portion and said second, angled portion and a second fulcrum point located at an outer margin of said coupler centering surface.

5. The coupler of claim 4 wherein said co-linear portion is parallel to said stationary centering surface and said angled portion is angled at between about 2° to 5° away from said co-linear portion.

6. The coupler of claim 5 wherein said coupler head includes a coupler head side flange thereon for preventing over rotation of said coupler knuckle and resultant entrapment of a knuckle on a connected unit of rolling stock, said coupler head side flange having a flat, inner-facing surface which is parallel to said shank axis.

7. A model railroad coupler for use between two units of model railroad rolling stock, each unit of rolling stock having a rolling stock longitudinal axis, and a coupler box for receiving a coupler therein, the coupler box being located about the rolling stock longitudinal axis and further having a coupler pivot pin therein, each coupler comprising:

(1) a coupler head and a coupler knuckle carried pivotally on said coupler head;

(2) an elongate coupler shank having one end thereof fixed to said coupler head;

(3) a coupler mounting structure carried at the other end of said coupler shank, said shank having a shank longitudinal axis;

wherein said coupler head includes a coupler head side flange thereon for preventing over rotation of said coupler knuckle and resultant entrapment of a knuckle on a connected unit of rolling stock, said coupler head side flange having a flat, inner-facing surface which is parallel to said shank axis; and wherein said coupler mounting structure includes an elongate slot therein having a coupler centering spring seat at one end thereof and a spring interposed said coupler centering spring seat and the pivot pin for maintaining the coupler in a centered position when said shank longitudinal axis and said rolling stock longitudinal axis are substantially parallel, said coupler mounting structure having a coupler centering surface adjacent another end thereof for providing at least a two position swinging of the coupler during an uncoupling operation, wherein said coupler centering surface has a first, co-linear portion and a second, angled portion, wherein a first fulcrum point is located between said first, co-linear portion and said second, angled portion and a second fulcrum point located at an outer margin of said coupler centering surface.

8. The coupler of claim 7 wherein said co-linear portion is parallel to said stationary centering surface and said angled portion is angled at between about 2° to 5° away from said co-linear portion.

* * * * *